US007874073B2

(12) United States Patent
Ogawa et al.

(10) Patent No.: US 7,874,073 B2
(45) Date of Patent: Jan. 25, 2011

(54) NOSE HAIR CUTTER

(75) Inventors: Hitoshi Ogawa, Inukami (JP); Hisao Nakagawa, Nagahama (JP)

(73) Assignee: Panasonic Electric Works Co., Ltd., Kadoma-Shi, Osaka (JP)

( * ) Notice: Subject to any disclaimer, the term of this patent is extended or adjusted under 35 U.S.C. 154(b) by 100 days.

(21) Appl. No.: 11/461,601

(22) Filed: Aug. 1, 2006

(65) Prior Publication Data

US 2007/0028447 A1 Feb. 8, 2007

(30) Foreign Application Priority Data

Aug. 5, 2005 (JP) ..... 2005-228688

(51) Int. Cl.
*B26B 19/18* (2006.01)
*B26B 19/44* (2006.01)

(52) U.S. Cl. ..... 30/29.5; 30/41.5; 30/133

(58) Field of Classification Search ..... 30/29.5, 30/41, 41.5, 41.6, 133
See application file for complete search history.

(56) References Cited

U.S. PATENT DOCUMENTS

| | | | | | |
|---|---|---|---|---|---|
| 2,129,559 | A | * | 9/1938 | Blackwell | 30/41.5 |
| 2,223,410 | A | * | 12/1940 | Faveluke | 30/41.5 |
| 2,267,626 | A | * | 12/1941 | Stainbrook | 30/41.5 |
| 2,371,535 | A | * | 3/1945 | McGuffin | 30/41.5 |
| 2,899,743 | A | * | 8/1959 | Heuvel | 30/34.05 |
| 3,054,179 | A | * | 9/1962 | Reiser et al. | 30/29.5 |
| 3,369,294 | A | * | 2/1968 | Shaw et al. | 30/41.5 |
| 3,699,652 | A | | 10/1972 | Deverman et al. | |
| 5,012,576 | A | | 5/1991 | Johannesson | |
| 5,075,971 | A | | 12/1991 | McCambridge | |

FOREIGN PATENT DOCUMENTS

| | | |
|---|---|---|
| JP | 4-80402 | 7/1992 |
| JP | 7-51472 | 2/1995 |
| JP | 7-313244 | 12/1995 |
| JP | 8-066569 | 3/1996 |
| JP | 9-154626 | 6/1997 |
| JP | 2000-342327 | 12/2000 |
| JP | 2004-089731 | 3/2004 |
| KR | 20-0310081 | 3/2003 |

OTHER PUBLICATIONS

English language Abstract of KR 20-0310081.
English language Abstract of JP 2004-089731.
English language Abstract of JP 8-066569.
English Language Abstract of JP 9-154626.
U.S. Appl. No. 11/457,845 to Morisugi et al., filed Jul. 17, 2006.

* cited by examiner

*Primary Examiner*—Hwei-Siu C Payer
(74) *Attorney, Agent, or Firm*—Greenblum & Bernstein, P.L.C.

(57) ABSTRACT

To provide a nose hair cutter, comprising a blade configures to cut nose hair, a motor which drives a movable blade of the blade, and a fan which is driven by the motor to suck pieces of the nose hair cut by the blade into a body.

4 Claims, 5 Drawing Sheets

NOSE HAIR CUTTER

CROSS REFERENCE TO RELATED APPLICATIONS

This application is based upon and claims the benefit of priority from prior Japanese Patent Application P2005-228688 filed on Aug. 5, 2005; the entire contents of which are incorporated by reference herein.

BACKGROUND OF THE INVENTION

The present invention relates to a nose hair cutter.

As a conventional nose hair cutter, as disclosed in Japanese Patent Application Laid-open No. H09-154626, there is a known nose hair cutter in which a blade is inserted into a nostril of a user to cut nose hair. If pieces of the nose hair cut by the blade are scattered in the nostril, since it is difficult for the user to see inside the nostril even if the user uses a mirror, the nose hair pieces cannot easily be removed from the nostril, and the pieces may remain in the nostril as foreign matter. If the nose hair pieces which cannot easily be removed attach to a mucous membrane of inner surface of the nostril, the pieces keep stimulating the mucous membrane of the inner surface of the nostril, a large amount of snivel secreted or dry mucus is generated and an excellent feeling of use of the nose hair cutter cannot be obtained.

SUMMARY OF THE INVENTION

The present invention has been achieved in view of the conventional problem, and it is an object of the invention to provide a nose hair cutter capable of preventing pieces of cut nose hair from scattering into a nostril while preventing the nose hair cutter from being increased in size.

To achieve the above object, a first aspect of the present invention provides a nose hair cutter, comprising a blade configures to cut nose hair, a motor which drives a movable blade of the blade, and a fan which is driven by the motor to suck pieces of the nose hair cut by the blade into a body. According to this configuration, the pieces of nose hair are sucked into the body by the fan, it is possible to prevent the pieces of nose hair from scattering into the nostril, and to enhance a feeling of use of the nose hair cutter. Furthermore, since the fan and the movable blade of the blade are driven by the same motor, the nose hair cutter is reduced in size.

A second aspect of the present invention provides the nose hair cutter according to the first aspect, wherein a rotation speed of the movable blade rotated by the motor and a rotation speed of the fan are different from each other. With this configuration, it is possible to set the rotation speed of the movable blade suitably for cutting nose hair, and to set the rotation speed of the fan suitably for sucking the pieces of nose hair. If the fan is rotated at high speed to increase the output, it is possible to obtain the high output without increasing the fan in size, and it is possible to make the fan and nose hair cutter compact.

A third aspect of the present invention provides the nose hair cutter according to the first or the second aspect, further comprising a filter detachably provided in an air flow path extending from the blade to the fan and configured to collect the pieces of the nose hair. With this configuration, pieces of nose hair can be collected by the filter before the pieces attach to the motor or fan, the filter can be detached from the body without being hindered by the fan or the like and the pieces of nose hair can be removed, and maintenance of the nose hair cutter can easily be performed.

A fourth aspect of the present invention provides the nose hair cutter according to any one of the first to the third aspects, wherein a cylindrical body comprises the air flow path for the pieces of nose hair, one end of the cylindrical body is provided with an opening as a suction port of pieces the air flow path, the cylindrical body constitutes an outer frame body of the blade to be inserted into a nostril of a user, an edge of a side surface of the cylindrical body is notched to form a nose hair introducing part, nose hair introduced into the air flow path in the outer frame body which is the cylindrical body from the nose hair introducing part are cut by a stationary blade constituted by an edge of the nose hair introducing part and by a movable blade which rotates and slides on an inner surface of the stationary blade. With this configuration, the outer frame body includes the cylindrical body which is suitable for cutting the nose hair extending inward from the inner surface of the nostril and suitable for not releasing the pieces of nose hair outside. The shape of the outer frame body is also suitable for generating stable air flow as the air flow path. Thus, it is possible to efficiently and reliably flow the pieces of nose hair cut in the outer frame body toward the downstream of the air flow path by the stable air flow.

The present invention has an advantage such that the nose hair cutter can be made compact, it is possible to prevent pieces of cut nose hair from scattering into a nostril, and to provide its user with an excellent feeling of use.

BRIEF DESCRIPTION OF THE DRAWINGS

FIG. 4A is a front view thereof, FIG. 4B is a side view thereof, and FIG. 4C is a bottom view thereof;

DETAILED DESCRIPTION OF THE PREFERRED EMBODIMENTS

Embodiments of the present invention will be explained below with reference to the accompanying drawings.

FIGS. 1 to 6 show a nose hair cutter according to one embodiment of the present invention. The nose hair cutter is an electric device having a body 1. The body 1 is grasped by a user. The body 1 is provided at its one end with a blade 2. The blade 2 is inserted into a nostril of the user to cut nose hair. In the following explanation, the one end of the body 1 provided with the blade 2 is defined as an upper portion (shown with arrows A in FIG. 4) and the other end opposite from the one end of the body 1 is defined as a lower portion (shown with arrows B in FIG. 4).

Figure 4A:
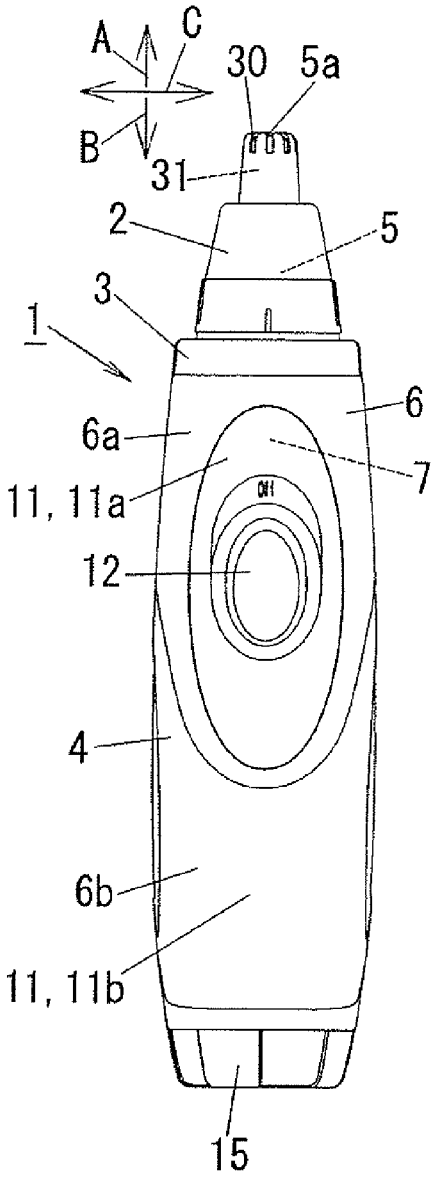
FIGS. 4A to 4C show the nose hair cutter according to the embodiment, where
Figure 4B:
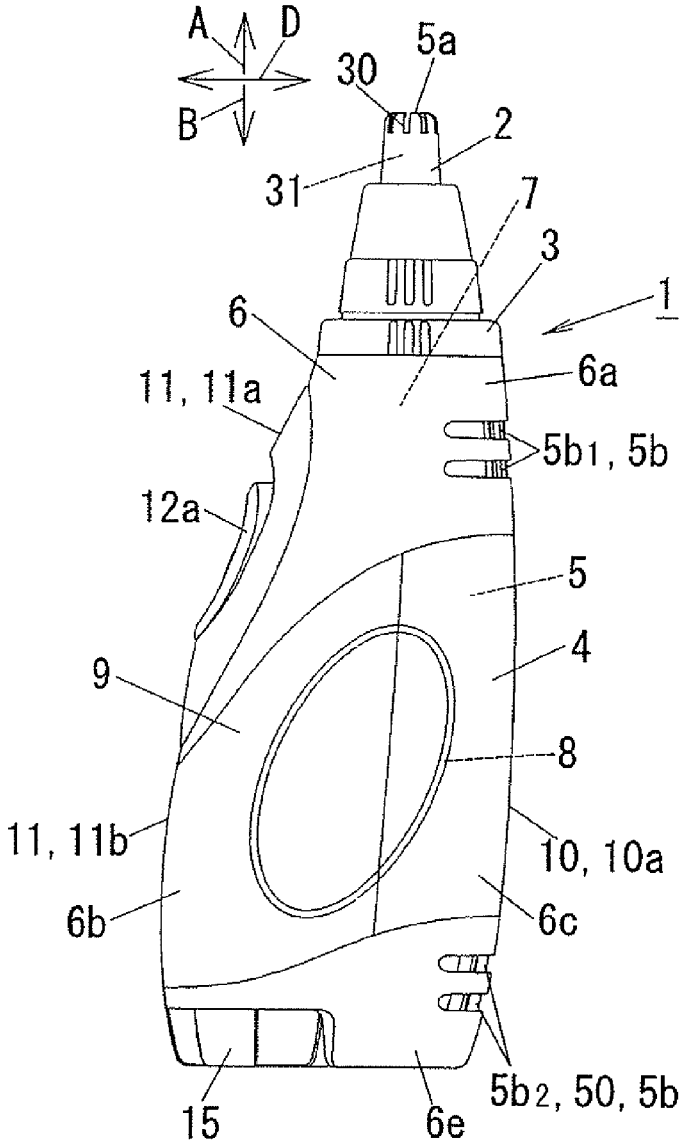
Figure 4C:
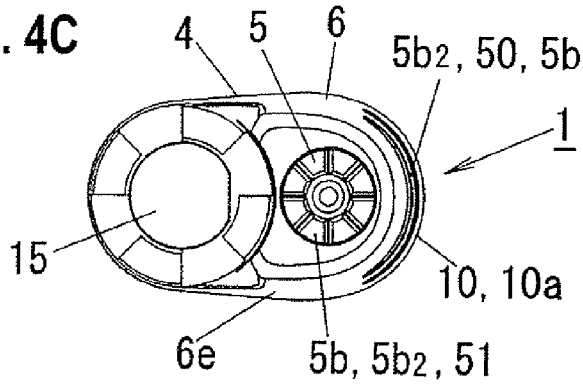

In FIG. 4, the body 1 includes the blade 2, a filter 3 and a main body 4 which is a grip, and they are disposed from the upper side in this order. An air flow path 5 is formed in the body 1 such as to extend vertically (i.e., the air flow path 5 penetrates the blade 2, the filter 3 and the main body 4), and air flows through the air flow path 5.

Figure 1:
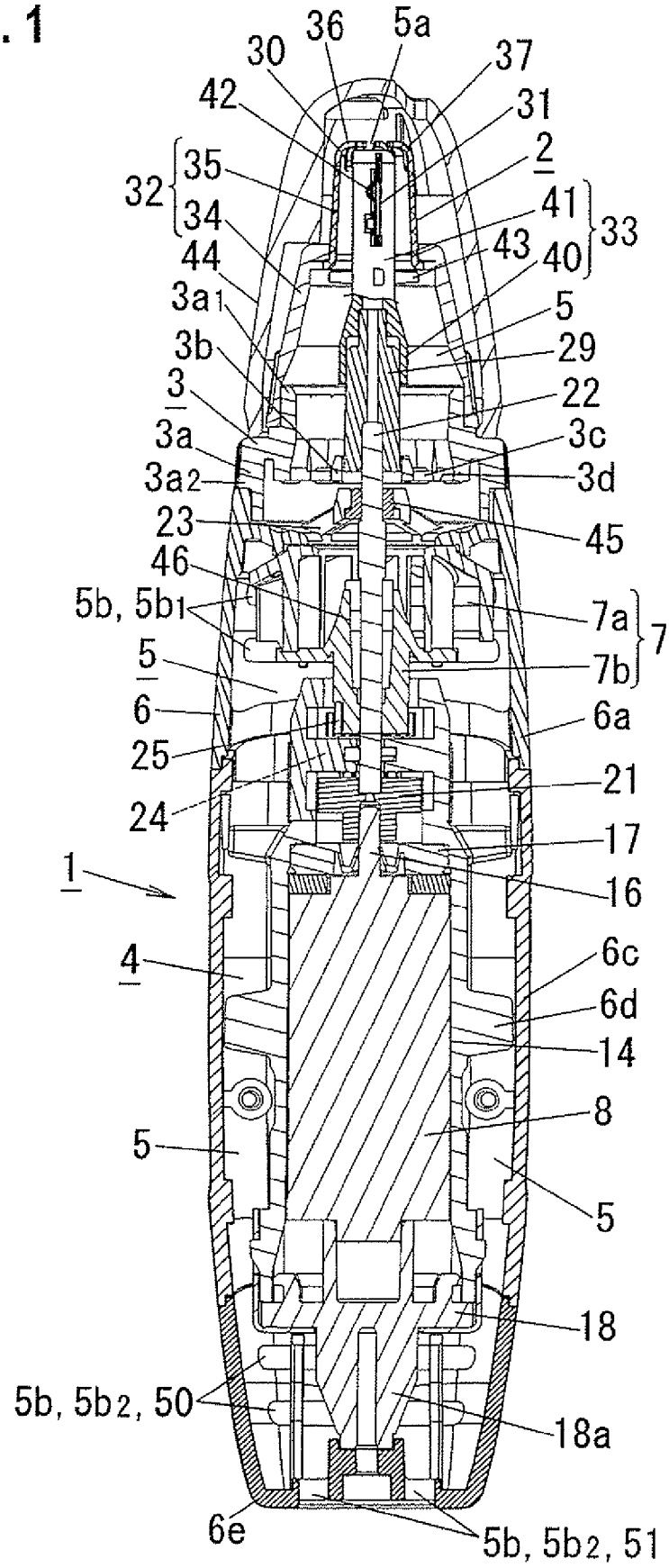
FIG. 1 is a front sectional view of a nose hair cutter according to an embodiment of the present invention.
Figure 2:
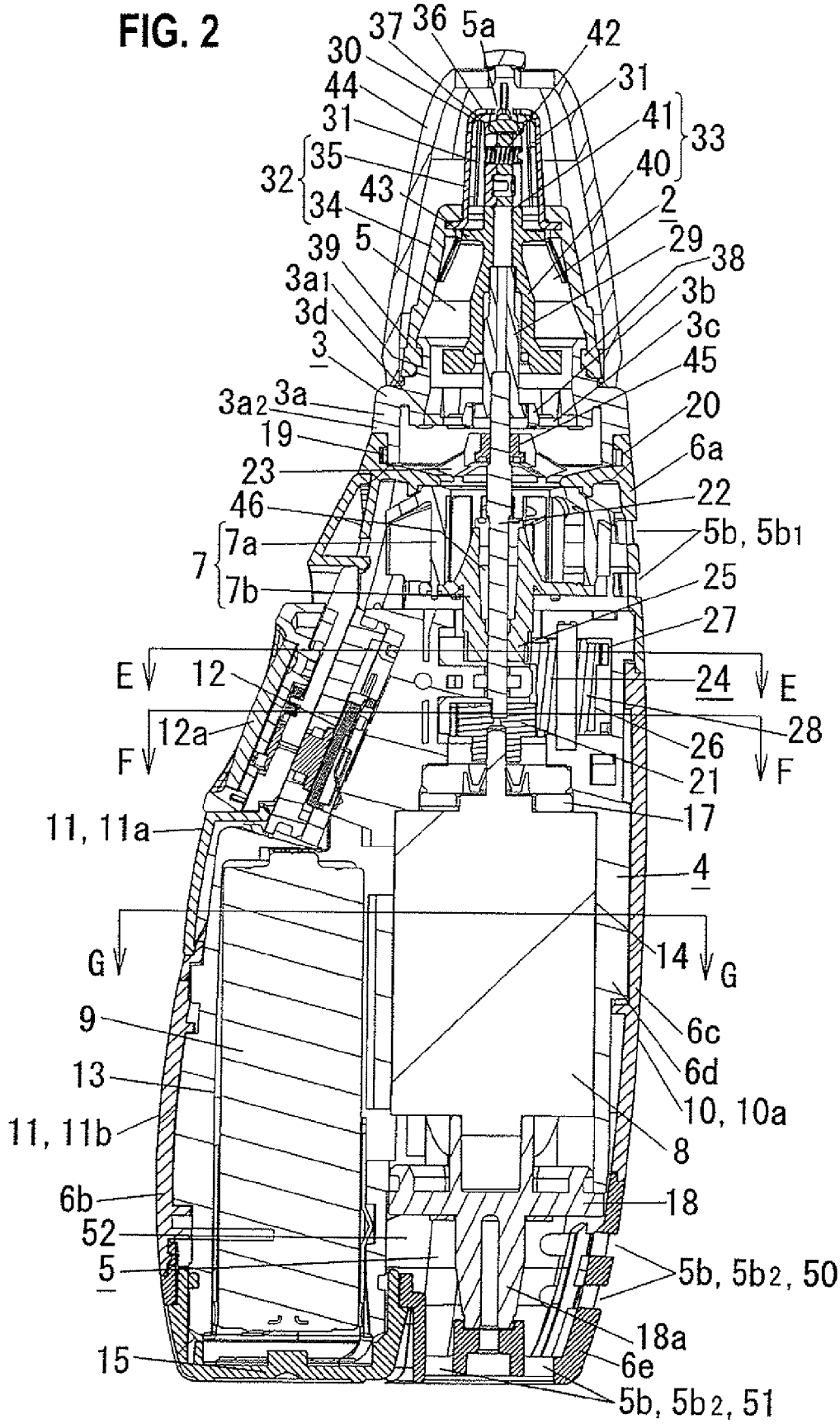
FIG. 2 is a side sectional view of the nose hair cutter according to the embodiment.
Figure 3A:
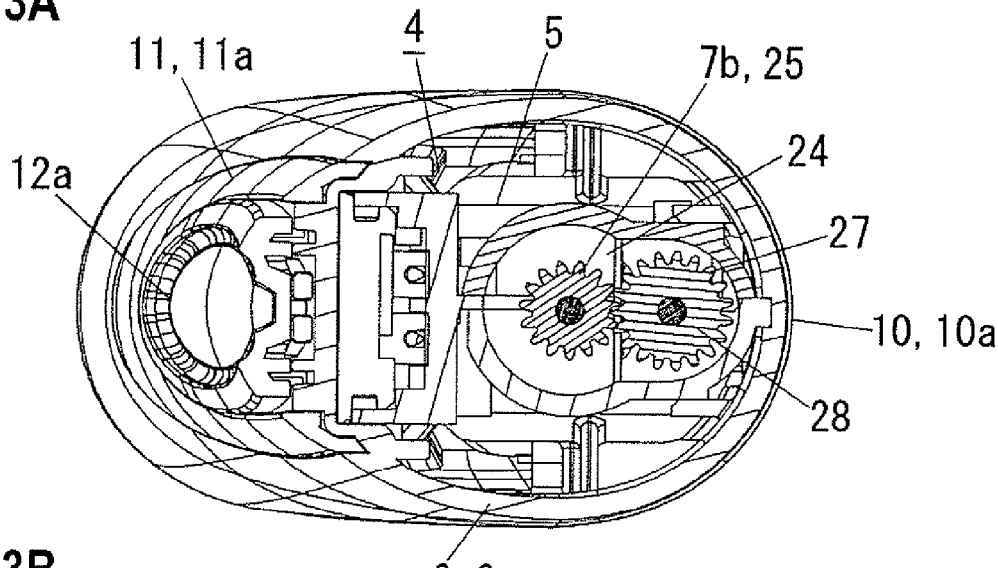
FIG. 3A is a sectional view taken along the line E-E in FIG. 2.
Figure 3B:
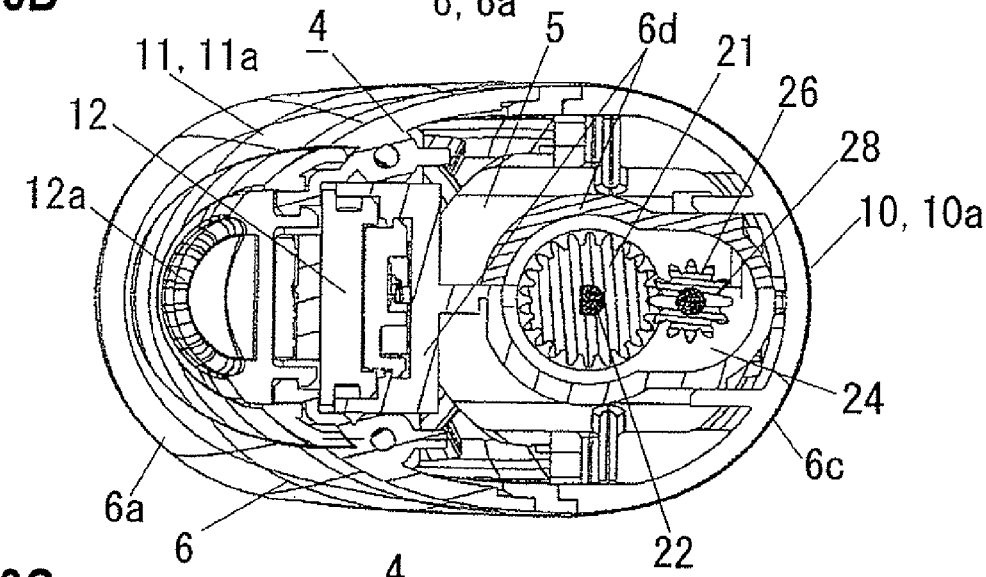
FIG. 3D is a sectional view taken along the line F-F in FIG. 2.
FIG. 3C is a sectional view taken along the line G-G in FIG. 2.
Figure 3C:
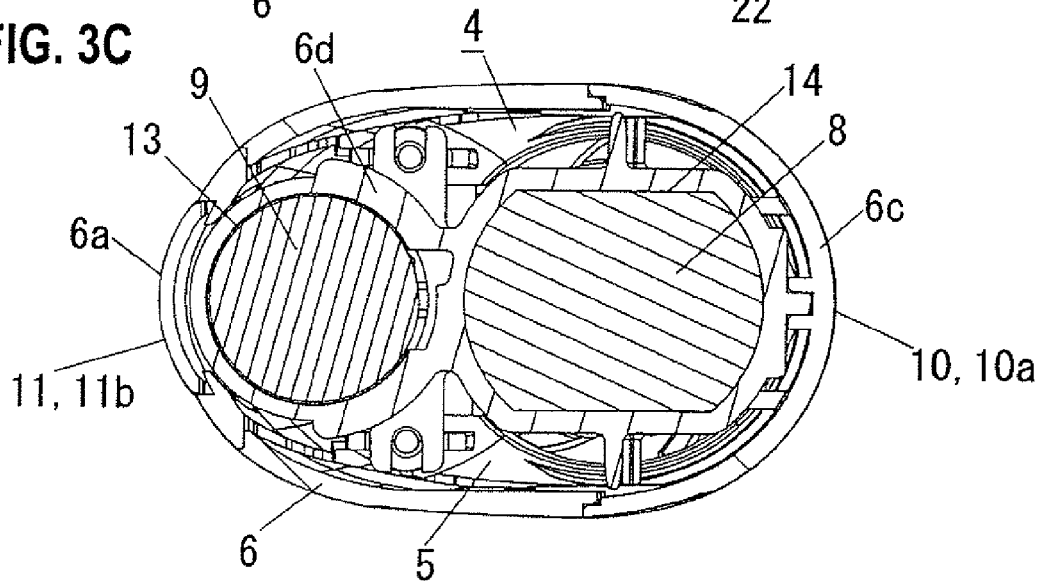

As shown in FIGS. 1 to 3, the main body 4 includes a bottomed cylindrical housing 6 which is vertically long. An upper portion of the housing 6 is opened. A fan 7, a motor 8, and a battery 9 which drives the motor 8, are accommodated in the housing 6. More specifically, the fan 7 and the motor 8 are coaxially disposed in the air flow path 5 from the upper side in this order. The battery 9 is disposed sideway of the motor 8 away from the air flow path 5. Thus, the housing 6 has a shape projecting sideway at the location where the battery 9 is disposed. An adjacent direction of the battery 9 and the motor 8 on the side is defined as a front-rear direction (arrow D in FIG. 4), and a direction perpendicular to the front-rear direction and the vertical direction on the side is defined as a lateral direction (arrow C in FIG. 4). The housing 6 has substantially constant thickness in the lateral direction, and one end surface (rear end surface) 10 in the front-rear direction includes a straight surface portion 10*a* which is substantially flat in the vertical direction along the fan 7 and the motor 8 which are coaxially disposed. The other end surface (front end surface) 11 in the front-rear direction is provided at its upper portion with an inclined surface portion 11*a* swelling outward in the downward direction for accommodating the battery 9 adjacent to the motor 8. A substantially flat straight surface portion 11*b* is continuously formed on a lower portion of the housing 6 along the battery 9. A switch 12 is disposed in a waterproof manner above the battery 9 in the housing 6. The switch 12 switches over between ON and OFF of the nose hair cutter. A switch handle 12*a* is disposed on the inclined surface portion 11*a* of the housing 6 such that the switch handle 12*a* is exposed outside.

More specifically, the housing 6 includes an upper housing 6*a*, a front surface housing 6*b*, a rear housing 6*c*, an internal housing 6*d*, and a bottom housing 6*e*. The internal housing 6*d* is disposed in a space surrounded by the upper housing 6*a*, the front surface housing 6*b*, the rear housing 6*c* and the bottom housing 6*e*. A battery accommodation recess 13 and a motor accommodation recess 14 are formed in the internal housing 6*d* such that they open downward. The battery accommodation recess 13 and the motor accommodation recess 14 are arranged in the front-rear direction. The battery 9 is accommodated in the battery accommodation recess 13, and the motor 8 is accommodated in the motor accommodation recess 14. A lower end of the battery accommodation recess 13 downwardly projects from the bottom housing 6*e*. A battery cover 15 is made waterproof and is detachably mounted on the lower opening of the battery accommodation recess 13. A lower end surface of the battery cover 15 mounted on the battery accommodation recess 13 and a lower end surface of the bottom housing 6*e* are flush with each other, and the nose hair cutter can be brought into an upright state. In a state where the motor 8 is accommodated in the motor accommodation recess 14, the motor shaft 16 projects upward, the upper portion of the motor 8 is covered with a packing material 17, the lower opening of the motor accommodation recess 14 is covered through an O-ring with a base cover 18 to make it waterproof. The base cover 18 is formed at its central portion with a boss 18*a* which downwardly projects. The boss 18*a* and the bottom housing 6*e* are screwed to each other. A space between the internal housing 6*d*, the upper housing 6*a* which covers the periphery of the internal housing 6*d*, the front surface housing 6*b*, the rear housing 6*c* and the bottom housing 6*e* constitutes the air flow path 5 formed in the main body 4.

Figure 6:
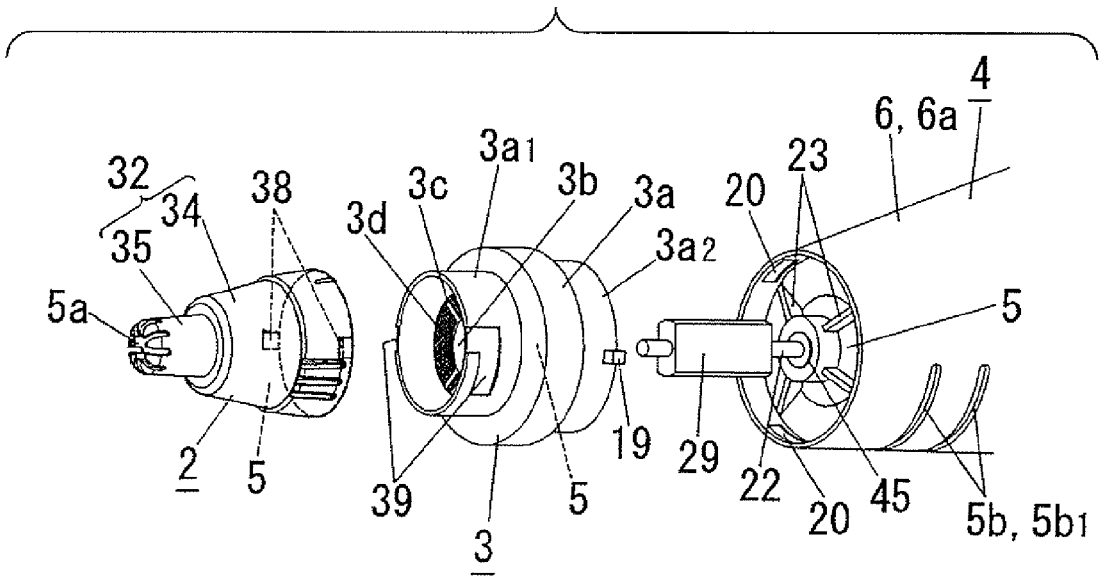
FIG. 6 is an exploded perspective view of relevant parts of the nose hair cutter according to the embodiment.

The upper opening of the housing 6 formed in the upper housing 6*a* is a portion which becomes a connection opening with respect to the air flow path 5 of the blade 2. A filter 3 which collects pieces of nose hair is detachably mounted on this portion. The filter 3 is provided at its periphery with a cylindrical outer frame 3*a* which is continuous with the housing 6, and a cylindrical inner frame 3*b* which is connected to the inside of the outer frame 3*a* through the rib 3*c*. A mesh portion 3*d* which collects pieces of the nose hair is formed between the outer frame 3*a* and the inner frame 3*b*. If the filter 3 is located at the upper opening of the housing 6 and is rotated around a vertical axis, an engagement projection 19 provided on an outer edge surface of a lower portion 3*a*2 of the outer frame 3*a* is detachably engaged with an engagement groove 20 formed in an inner edge surface of the upper opening of the housing 6 by a bayonet fastening structure which is engaged with and disengaged from the engagement groove 20 (FIG. 6). A lower portion 3*a*2 of the outer frame 3*a* mounted on an upper opening of the housing 6 has a greater diameter than that of an upper portion 3*a*1 of the outer frame 3*a* on which a mounting frame 34 of a later-described internal frame body 33.

A pinion gear 21 is mounted on the motor shaft 16 of the motor 8 which projects upward from the motor accommodation recess 14. A metal drive shaft 22 is mounted on the pinion gear 21 coaxially with the motor shaft 16. The drive shaft 22 rotates in unison with the motor shaft 16. The drive shaft 22 penetrates a later-described bearing 46 of the fan 7 and the inner frame 3*b* of the filter 3. The drive shaft 22 projects above the housing 6 in a state where the drive shaft 22 is rotatably supported by a bearing 45 which is integrally formed from the upper opening edge of the housing 6 through a rib 23. A joint 29 for mounting an internal body 33 of the blade 2 is press fitted and mounted on an upper end of the drive shaft 22.

In the fan 7, a centrifugal fan 7*a* is provided at its peripheral edge with a large number of vanes. The centrifugal fan 7*a* is integrally fixed to a fan base 7*b* by means of heat seal. The fan base 7*b* is provided at its central portion with a bearing 46. The fan 7 is rotatably mounted on a drive shaft 22 through the bearing 46. That is, the fan 7 does not rotate in unison with the motor shaft 16 or drive shaft 22. The fan 7 is connected to the motor 8 through a speed converter 24. The speed converter 24 makes a rotation speed on the output side and a rotation speed on the input side different from each other. More specifically, the speed converter 24 includes a pinion gear 21 mounted on the motor shaft 16, a fan gear portion 25 provided on the fan base 7*b*, and an intermediate gear 28 which is rotatably provided in the housing 6. The intermediate gear 28 is coaxially and integrally formed with a first gear 26 which meshes with the pinion gear 21 and a second gear 27 which meshes with the fan gear portion 25. In this embodiment, the number of teeth of the pinion gear 21 is 22, the number of teeth of the first gear 26 of the intermediate gear 28 is 12, the number of teeth of the second gear 27 of the intermediate gear 28 is 19, and the number of teeth of the fan gear portion 25 is 15. That is, the rotation speed of the fan 7 is set 2.32 times faster than the rotation speed of the motor shaft 16.

Figure 5:
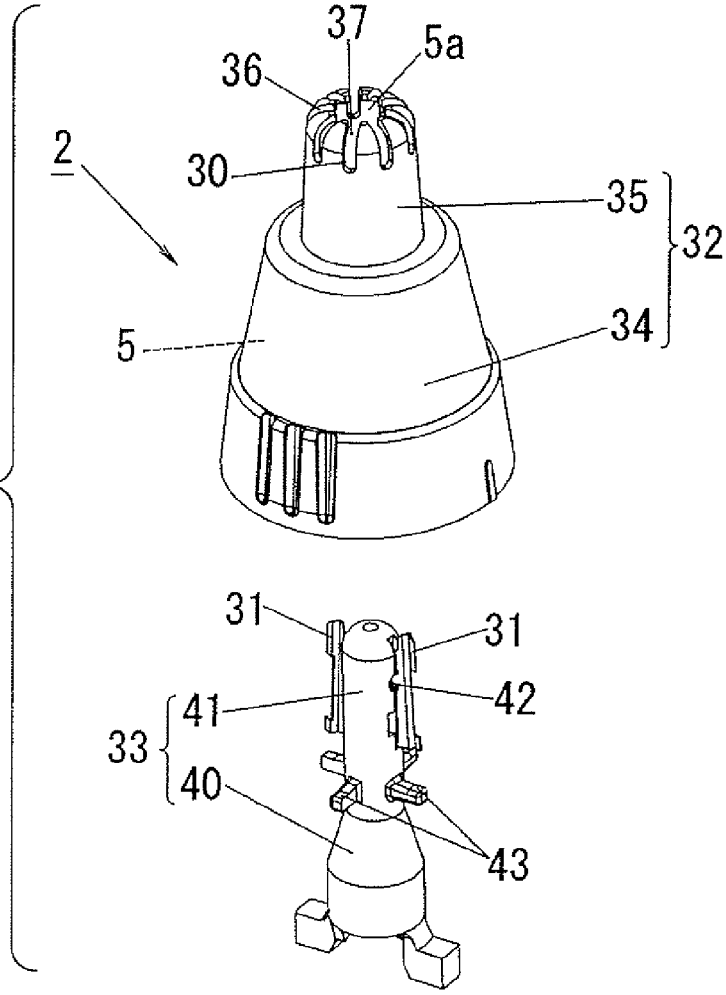
FIG. 5 is an exploded perspective view of a blade according to the embodiment.

As shown in FIG. 5, the blade 2 cuts nose hair by a stationary blade 30 and a movable blade 31. The blade 2 includes an outer frame body 32 having the stationary blade 30, and an internal body 33 having the movable blade 31. The outer frame body 32 is a cylindrical body whose upper and lower portions are opened. The outer frame body 32 is detachably mounted on an upper portion of the filter 3. The internal body 33 is detachably mounted on the joint 29 and is rotated in unison with the motor shaft 16. More specifically, the outer frame body 32 includes a cylindrical body, a mounting frame 34 is mounted on the filter 3, a metal nostril inserting unit 35 to be inserted into the nostril is integrally mounted on an upper portion of the mounting frame 34. The nostril inserting unit 35 is formed at its upper end with a bending unit 36 which is bent inward so that the inside of the nostril is not damaged even if the nostril inserting unit 35 inserted into the nostril comes into contact with the inside of the nostril. A plurality of nose hair introducing parts 37 are formed in a side surface of the nostril inserting unit 35 such that nose hair introducing parts 37 are notched in form of slits, and the stationary blade 30 is formed on an edge of each of the nose hair introducing parts 37. The mounting frame 34 has a greater diameter than that of the nostril inserting unit 35, and the diameter of the mounting frame 34 expands, as it extends downwardly. An engagement projection 38 (FIG. 6) is inwardly projects from an inner edge surface of a lower portion of the mounting frame 34. If the outer frame body 32 is located at the upper portion of the filter 3 and is rotated around a vertical axis, the engagement projection 38 of the mounting frame 34 is detachably engaged with an engagement groove 39 formed in an outer edge surface of the upper portion 3*a*1 of the outer frame 3*a* of the filter 3 by means of a bayonet fastening structure which is engaged with and disengaged from the engagement groove 39 (FIG. 6). The internal body 33 includes a fitting unit 40 which is fitted over the joint 29. An inserting projection 41 which is inserted into the nostril inserting unit 35 projects upward of the fitting unit 40. The movable blade 31 projects from the inserting projection 41 through a spring 42, and a plurality of deflection-preventing projections 43 are projected from the inserting projection 41 sideway. If the motor 8 is driven, the internal body 33 rotates in unison with the motor shaft 16 and the drive shaft 22. At that time, deflection-preventing projections 43 slide and rotate on an inner peripheral surface of the nostril inserting unit 35 of the outer frame body 32, and the stable rotation of the internal body 33 is secured. In this state, the movable blade 31 slides and rotates on the inner peripheral surface of the stationary blade 30 of the outer frame body 32, nose hair introduced into the outer frame body 32 from the nose hair introducing part 37 is sandwiched between the movable blade 31 and the stationary blade 30 and is cut.

The inside of the outer frame body 32 constitutes the air flow path 5. An upper end opening of the outer frame body 32 and the nose hair introducing part 37 constitute a suction port 5*a* of the air flow path 5. The outer frame body 32 of the blade 2 of the nose hair cutter has a cylindrical shape which is easily inserted into the nostril and which is suitable for introducing the nose hair extending inward from the inner surface of the nostril into the outer frame body 32 and cutting the nose hair and not releasing the pieces of the nose hair outside. The cylindrical outer frame body 32 is also suitable for generating stable air flow therein. That is, the air flow path 5 capable of stably forming air flow by the fan 7 can be obtained. The nose hair is introduced into the outer frame body 32 which becomes the air flow path 5 and is cut. Thus, pieces of the nose hair are cut and dropped into the outer frame body 32 which becomes the air flow path 5, and the pieces are efficiently flowed downstream of the air flow path 5 by the stable air flow.

A side portion of the fan 7 of the main body 4 and a rear end of the main body 4 are provided with the air flow path 5. More specifically, a discharge port 5*b*1 is provided in the side of the fan 7, and the discharge port 5*b*1 is a long hole which is formed in a rear end surface 10 of the housing 6 on the opposite side from the switch handle 12*a* and which is parallel to a vertical axial direction of the body 1. A wind generated by the rotating centrifugal fan 7*a* can efficiently be discharged by the discharge port 5*b*1, and air flow can efficiently be generated in the air flow path 5. A discharge port 5*b*2 is formed in the rear end of the main body 4. The discharge port 5*b*2 includes a side discharge port 50 formed in the rear end surface 10 of the housing 6, and a bottom discharge port 51 formed in the lower end surface of the housing 6. The bottom discharge port 51 is substantially opposed to the upper opening of the housing 6 through the fan 7 and the motor 8 which are coaxially disposed. The bottom discharge port 51 functions as a main discharging path in the discharge port 5*b*2 in the rear end of the main body 4. The side discharge port 50 is formed into a long hole which is in parallel to the vertical axial direction of the body 1. The side discharge port 50 functions as an auxiliary discharge path for increasing the opening area of the discharge port 5*b*2 of the rear end unit of the main body 4. More specifically, the air flow path 5 of the lower end unit of the main body 4 is provided with a residual portion 52 which is a space between a boss 18*a* and a lower housing 6*e*. The side discharge port 50 and the bottom discharge port 51 constituting the discharge port 5*b*2 are opposed to the residual portion 52. The battery cover 15 constitutes a half of the lower end surface of the nose hair cutter, and the lower end surface of the lower housing 6*e* constitutes the rest half. The bottom discharge port 51 is provided on the lower end surface of the lower housing 6*e*.

That is, by the driven fan 7, air is introduced into the air flow path 5 in the body 1 from the upper end opening of the blade 2 and the suction port 5*a* constituted by the nose hair introducing part 37, and the air passes through the air flow path 5 in the body 1 and is discharged out from the body 1 through the discharge ports 5*b*. In the drawings, a reference numeral 44 represents a cap which protects the blade 2 when the nose hair cutter is accommodated. The cap is detachably fitted over the outer frame body 32.

In the nose hair cutter having the above structure, if the switch handle 12*a* is operated to turn the switch 12 ON and to supply electricity to the motor 8 from the battery 9 and to drive the motor 8, nose hair introduced into the outer frame body 32 which is the air flow path 5 from the nose hair introducing part 37 is cut by the stationary blade 30 and the movable blade 31 which is rotated and driven in unison with the motor shaft 16 of the motor 8. At that time, the motor 8 is driven to rotate and drive the fan 7 through the speed converter 24, and air flow is generated in the air flow path 5 by the fan 7. The pieces of nose hair cut and dropped in the cylinder of the outer frame body 32 flow downstream of the air flow path 5 by the air flow and collected by the filter 3. That is, the pieces of nose hair are prevented from scattering outside of the outer frame body 32 by the air flow, i.e., inside of the nostril. It is possible to avoid a troublesome case of a user caused when pieces of nose hair remain in his or her nostril, and it is possible to enhance the feeling of use of the nose hair cutter. The pieces of nose hair are collected by the filter 3 upstream of the air flow path 5 of the main body 4. Thus, pieces of nose hair are prevented from entering the main body 4. Especially, according to the nose hair cutter of the embodiment, the blade 2 is mounted on the filter 3 mounted on the main body 4. Therefore, nose hair cannot be cut by the blade 2 without the filter 3, and it is possible to reliably prevent pieces of nose hair from entering the main body 4. The filter 3 can be detached from the body 1 without being hindered by the fan 7 or the like and the filter 3 can be cleaned. Thus, maintenance of the nose hair cutter can easily be performed.

Furthermore, since the movable blade 31 and the fan 7 are driven by the same motor 8 commonly, the nose hair cutter can be reduced in size. Here, it is possible to use a large fan 7 having high output to make strong the air flow generated in the air flow path 5, but in this embodiment, the motor 8 and the fan 7 are connected to each other through the speed converter 24 which enhances the rotation speed of the fan 7 rather than the motor shaft 16. Thus, rotation speed for obtaining high output is secured in the fan 7 also by the motor 8 which is driven by the rotation speed suitable for the movable blade 31. That is, since high output can be secured also by a small fan 7, the fan 7 is made compact, and this reduces the nose hair cutter in size.

The air flow path 5 formed in the vertical direction of the body 1 penetrates the blade 2 at one end of the body 1 and penetrates the main body 4 in which the motor 8 is disposed. In other words, the blade 2, the motor 8 and the battery 9 are opposed to the air flow path 5. Thus, the blade 2, the motor 8 and the battery 9 are cooled by air flowing through the air flow path 5 when the fan 7 is driven, the blade 2, the motor 8 and the battery 9 are stably operated and their lifetimes are elongated. Furthermore, according to the air flow path 5 of the embodiment, the suction port 5*a* thereof and the bottom discharge port 51 of the discharge port 5*b* are located on one straight line and air easily passes, the sliding unit between the stationary blade 30 and the movable blade 31 of the blade 2 which are easily heated, the sliding unit between the inner peripheral surface of the inserting projection 41 and the deflection-preventing projections 43, and the motor 8 are disposed between the suction port 5*a* and the bottom discharge port 51. Therefore, especially the blade 2 and the motor 8 can effectively be cooled by air flowing through the air flow path 5 having excellent ventilation.

Since the discharge ports 5*b* of the air flow path 5 are provided near the fan 7 of one end of the body 1 and the other end of the body 1, the exhaust path of the air flow path 5 having a flow path area sufficient for normally operating the fan 7 is secured. A user grasps the body 1 near the blade 2 for precisely inserting the blade 2 into the nostril. Thus, the discharge port 5*b*1 of the air flow path 5 provided near the fan 7 of the body 1 is frequently blocked by the user's hand grasping the body 1. According to the nose hair cutter of the embodiment, however, the exhaust path of air flow by the fan 7 is secured by the discharge port 5*b*2 of the air flow path 5 provided on the other end of the body 1 is secured, and the fan 7 is normally operated. Furthermore, the discharge port 5*b*2 of the air flow path 5 provided on the other end of the body 1 of the embodiment has the bottom discharge port 51 provided on the rear end surface of the body 1 which is not a side surface of the body 1 which becomes a grasping surface to be grasped by a user. Therefore, the bottom discharge port 51 is not blocked by a user's hand grasping the body, and the reliability of the normal operation of the fan 7 is enhanced.

While the embodiment of the present invention has been described above, the invention is not limited to the above embodiment and changes and modifications can be made within the scope of the gist of the present invention.

What is claimed is:

1. A nose hair cutter comprising:

a blade assembly configured to cut nose hair, the blade assembly being provided at an upper part of a body of the nose hair cutter, a motor which drives a movable blade of the blade assembly, a fan which is driven by the motor to suck pieces of the nose hair cut by the blade assembly into the body of the nose hair cutter, and an air flow path extending from a suction port formed in an upper part of the blade assembly of the nose hair cutter to a first discharge port formed in a lower end surface of the body of the nose hair cutter for discharging air sucked from the suction port together with the pieces of the nose hair, a filter detachably provided in the air flow path and disposed between the blade assembly and the fan and configured to collect the pieces of the nose hair sucked by the fan, and wherein the filter is upstream of the air flow path while the fan is downstream of the air flow path as compared to the filter, wherein the air flow path penetrates the body of the nose hair cutter, and extends along an axial direction of the body of the nose hair cutter and the blade assembly of the nose hair cutter, wherein the motor and the fan are disposed in the air flow path, wherein the suction port, the fan, the motor, and the first discharge port are disposed along one straight line, wherein the blade assembly of the nose hair cutter comprises a cylindrical body comprising the air flow path for the pieces of nose hair therein, and wherein one end of the cylindrical body is provided with a bending unit configured to define the suction port for the pieces of nose hair to be sucked through the air flow path, and to prevent the blade assembly from damaging a nostril of a user when the nose hair cutter is inserted into the nostril to cut nose hair.

2. The nose hair cutter according to claim 1, wherein a rotation speed of the movable blade rotated by the motor and a rotation speed of the fan are different from each other.

3. The nose hair cutter according to claim 1, wherein the cylindrical body further includes:

an outer frame body of the blade assembly configured to be inserted into the nostril of the user, a nose hair introducing part configured as a notched edge of a side surface of the cylindrical body, a stationary blade provided at an edge of the nose hair introducing part, and the movable blade configured to rotate and slide on an inner surface of the stationary blade, wherein nose hair introduced into the air flow path is cut by the stationary blade and the movable blade.

4. The nose hair cutter according to claim 1, wherein a second discharge port of the air flow path is provided adjacent to a side portion of the fan.

* * * * *